US007907093B2

(12) United States Patent
Honda et al.

(10) Patent No.: US 7,907,093 B2
(45) Date of Patent: Mar. 15, 2011

(54) ELECTRONIC DEVICE AND METHOD FOR MANUFACTURING SAME

(75) Inventors: Satoru Honda, Kanagawa-ken (JP); Tomoko Honda, Kanagawa-ken (JP); Nobuyoshi Kuroiwa, Kanagawa-ken (JP); Masaomi Nakahata, Kanagawa-ken (JP); Jun Morimoto, Kanagawa-ken (JP); Yoshikazu Hata, Kanagawa-ken (JP); Koichi Sato, Tokyo (JP); Akihiro Tsujimura, Tokyo (JP); Makoto Tabata, Tokyo (JP); Minoru Sakurai, Tokyo (JP); Shoji Kato, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 419 days.

(21) Appl. No.: 12/133,410

(22) Filed: Jun. 5, 2008

(65) Prior Publication Data

US 2008/0303737 A1 Dec. 11, 2008

(30) Foreign Application Priority Data

Jun. 7, 2007 (JP) ..... 2007-151743

(51) Int. Cl.
*H01Q 1/24* (2006.01)

(52) U.S. Cl. ..... 343/702; 343/700 MS

(58) Field of Classification Search ..... 343/702, 343/700 MS, 872
See application file for complete search history.

(56) References Cited

U.S. PATENT DOCUMENTS

| | | | | |
|---|---|---|---|---|
| 6,891,505 | B2 * | 5/2005 | Kurjenheimo et al. | 343/702 |
| 2003/0122726 | A1 * | 7/2003 | Abbasi et al. | 343/846 |
| 2004/0227679 | A1 * | 11/2004 | Lu | 343/702 |
| 2007/0241971 | A1 * | 10/2007 | Tsujimura et al. | 343/702 |

FOREIGN PATENT DOCUMENTS

| | | |
|---|---|---|
| JP | 2001-111321 | 4/2001 |

* cited by examiner

*Primary Examiner* — Douglas W Owens
*Assistant Examiner* — Dieu Hien T Duong
(74) *Attorney, Agent, or Firm* — Finnegan, Henderson, Farabow, Garrett & Dunner, L.L.P.

(57) ABSTRACT

An electronic device includes a first molded body having a first frame, the first molded body being provided with a conductive pattern on its outer surface, a second molded body having a second frame, the second molded body being joined to the first molded body, a wiring sheet made of an insulative sheet provided with an interconnection pattern, a circuit board having a feed point, and a feed line having a first end extended to a mating surface of the first frame opposed to the second frame and a second end connected to the conductive pattern. The interconnection pattern has a first end connected to the one end of the feed line. The interconnection pattern has a second end connected to the feed point.

20 Claims, 6 Drawing Sheets

ELECTRONIC DEVICE AND METHOD FOR MANUFACTURING SAME

CROSS-REFERENCE TO RELATED APPLICATIONS

This application is based upon and claims the benefit of priority from the prior Japanese Patent Application No. 2007-151743, filed on Jun. 7, 2007; the entire contents of which are incorporated herein by reference.

BACKGROUND OF THE INVENTION

1. Field of the Invention

This invention relates to an electronic device and a method for manufacturing the same.

2. Background Art

An electronic device such as a mobile phone and a PDA (personal digital assistant) needs to include various types of antennas for voice communication as well as wireless LAN, television, radio, electronic payment, GPS, IC tag, and other communications.

In the case of an electronic device provided with such various types of antennas, the structure of connecting the antenna pattern on the casing outer surface to an on-board feed unit through a contact probe or a feed pin occupies a large installation space. This prevents the downsizing of the electronic device.

JP-A 2001-111321 (Kokai) discloses a feeding structure in which an antenna is placed inside the casing of a communication terminal apparatus and part of the antenna is directly in contact with an on-board feed unit.

SUMMARY OF THE INVENTION

According to an aspect of the invention, there is provided an electronic device comprising: a first molded body having a first frame, the first molded body being provided with a conductive pattern on its outer surface; a second molded body having a second frame, the second molded body being joined to the first molded body; a wiring sheet made of an insulative sheet provided with an interconnection pattern; a circuit board having a feed point; and a feed line having a first end extended to a mating surface of the first frame opposed to the second frame and a second end connected to the conductive pattern, the interconnection pattern having a first end connected to the one end of the feed line, and the interconnection pattern having a second end connected to the feed point.

According to another aspect of the invention, there is provided a method for manufacturing an electronic device, the electronic device including: a first molded body having a first frame, the first molded body being provided with a conductive pattern on its outer surface; a second molded body having a second frame, the second molded body being joined to the first molded body; a wiring sheet made of an insulative sheet provided with an interconnection pattern; a circuit board having a feed point; and a feed line having a first end extended to a mating surface of the first frame opposed to the second frame and a second end connected to the conductive pattern, the interconnection pattern having a first end connected to the one end of the feed line, the interconnection pattern having a second end connected to the feed point, the circuit board being bonded to the first molded body or the second molded body, and the wiring sheet having a first end sandwiched between the first and second frame, the second molded body being provided with a positioning rib, and the wiring sheet being provided with a notch engaged with the positioning rib, the method including: engaging the notch with the positioning rib; bonding the circuit board to the first or second molded body; and fixing the wiring sheet so that the wiring sheet is sandwiched between the first and second molded body.

According to another aspect of the invention, there is provided a method for manufacturing an electronic device, the electronic device including: a first molded body having a first frame, the first molded body being provided with a conductive pattern on its outer surface; a second molded body having a second frame, the second molded body being joined to the first molded body; a wiring sheet made of an insulative sheet provided with an interconnection pattern; a circuit board having a feed point; and a feed line having a first end extended to a mating surface of the first frame opposed to the second frame and a second end connected to the conductive pattern, the interconnection pattern having a first end connected to the one end of the feed line, and the interconnection pattern having a second end connected to the feed point, the second molded body is provided with a positioning rib, and the wiring sheet is provided with a notch engaged with the positioning rib, the method including: engaging the notch with the positioning rib; and fixing a second end of the wiring sheet and the circuit board so that a second end of the wiring sheet and the circuit board are sandwiched between the first and second pressing rib and that a first end of the wiring sheet is sandwiched between the first and second molded body.

DETAILED DESCRIPTION OF THE INVENTION

Embodiments of the invention will now be described with reference to the drawings.

FIG. 1 includes schematic views showing the configuration of an electronic device according to an embodiment of the invention. The electronic device of FIG. 1 is illustratively a mobile phone or a PDA, and includes a folding or sliding structure. FIG. 1A shows a first molded body 10, FIG. 1B shows a circuit board 30, FIG. 1C shows a wiring sheet 40, and FIG. 1D shows a second molded body 20.

Figure 5A:
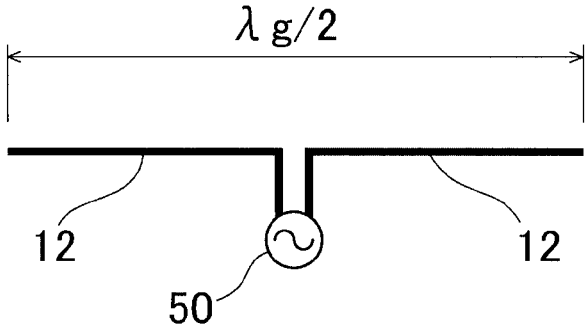
FIGS. 5A to 5D are views showing the configuration of the antenna.

In this embodiment, one end of the wiring sheet 40 is sandwiched between the first molded body 10 and the second molded body 20. The other end of the wiring sheet 40 and a feed point 32 of the circuit board, in electrical contact with each other, are sandwiched between the pressing ribs constituting the first and second molded body 10, 20. The first and second molded body 10, 20 include resin, for example. In FIG. 5C, while the wiring sheet 40 has an opening 41 having a closed periphery, the wiring sheet 40 can alternatively be U-shaped, for example.

The first and second molded body 10, 20 are securely joined together to constitute one of the casings of a folding or sliding electronic device. This casing is to include a liquid crystal display, for example, and the other casing is to include a keyboard, a secondary battery, and a circuit board.

Figure 1A:
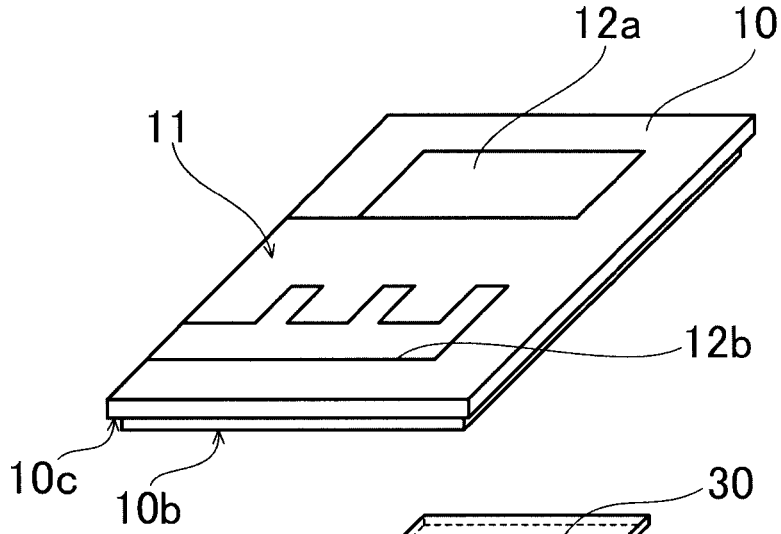
FIGS. 1A to 1D are schematic views showing the configuration of an electronic device according to an embodiment of the invention.
Figure 1B:
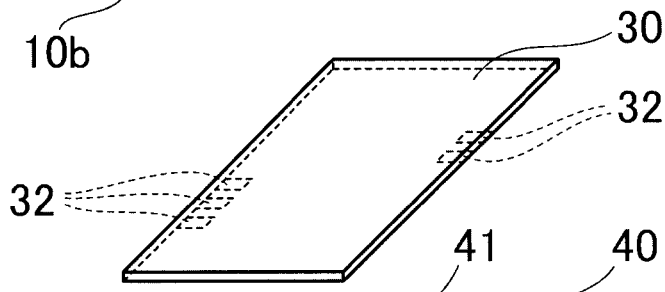
Figure 1C:
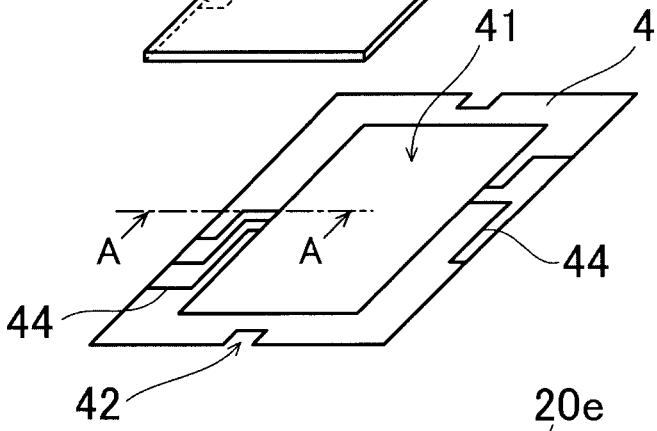
Figure 1D:
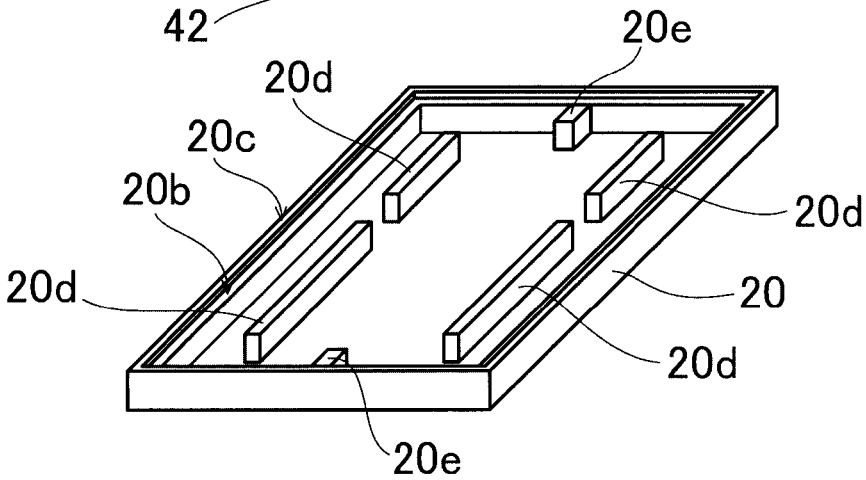
Figure 2A:
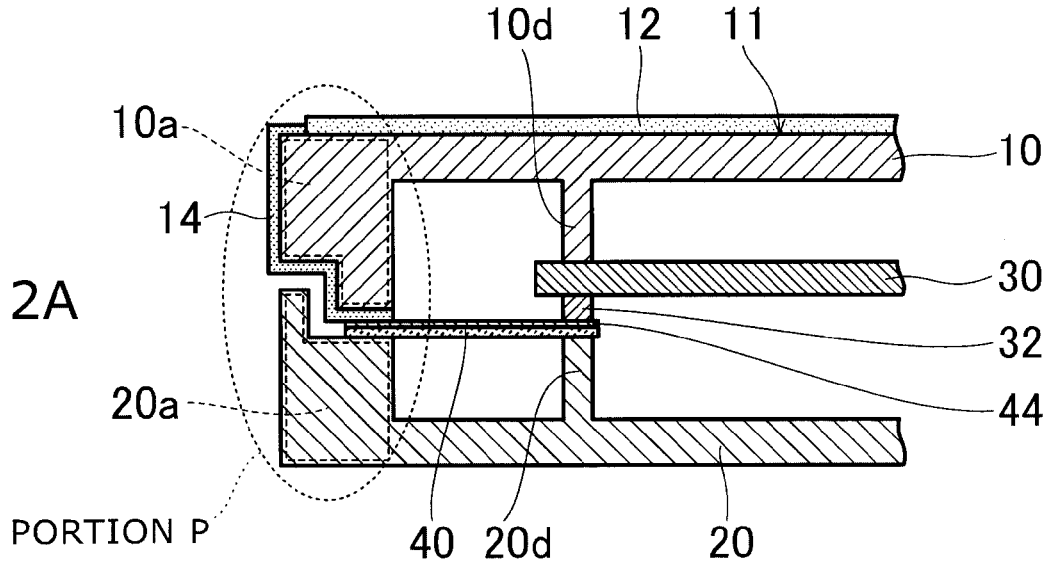
FIGS. 2A and 2B are schematic partial cross-sectional views of the electronic device of FIG. 1.
Figure 2B:
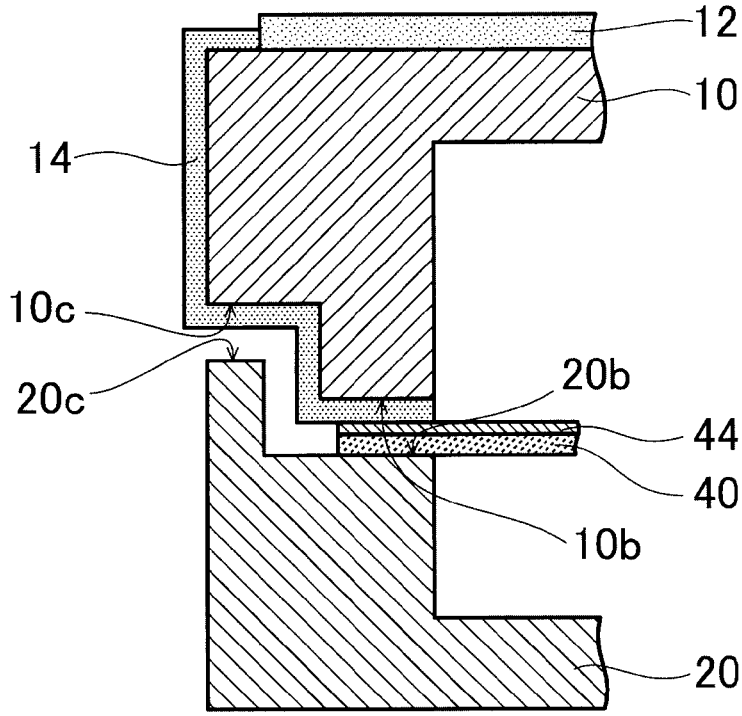

FIG. 2 shows cross-sectional views of the casing, where FIG. 2A is a partial schematic cross-sectional view taken along the dot-dashed line AA of FIG. 1C, and FIG. 2B is a partial enlarged schematic cross-sectional view in the portion P of FIG. 2A for illustrating the mating surfaces of the first and second molded body. In the following, the structure of this embodiment is described in more detail with reference to FIGS. 1 and 2. As shown in FIGS. 1A and 2, a conductive pattern 12 such as an antenna is formed by printing, painting, or plating on the outer surface 11 of the first molded body 10 illustratively made of resin. In FIG. 1, two conductive patterns 12*a* and 12*b* serving as antennas are formed.

The first molded body 10 has a first frame 10*a*, which presses the wiring sheet 40 from above at a feed line 14 on the surface 10*b* of the frame 10*a*. Furthermore, the first molded body 10 has a pressing rib 10*d* inside, which presses the circuit board 30 from above.

The second molded body 20 has a second frame 20*a*, which presses the wiring sheet 40 from below at the surface 20*b* of the frame 20*a*. Furthermore, the second molded body 20 has a pressing rib 20*d* inside, which presses the wiring sheet 40 and the circuit board 30 having the feed point 32 from below.

Furthermore, the feed line 14 extends from its one end located on the surface 10*b* of the frame 10*a* through a stepped surface 10*c* and the outer surface of the frame 10*a* to the other end connected to the conductive pattern 12.

As shown in FIG. 1B, the circuit board 30 is provided with a feed point 32 connected to the on-board circuit component. The feed point 32 is connected to the conductive pattern 12 through an interconnection pattern 44 of the wiring sheet 40 and the feed line 14.

Figure 3:
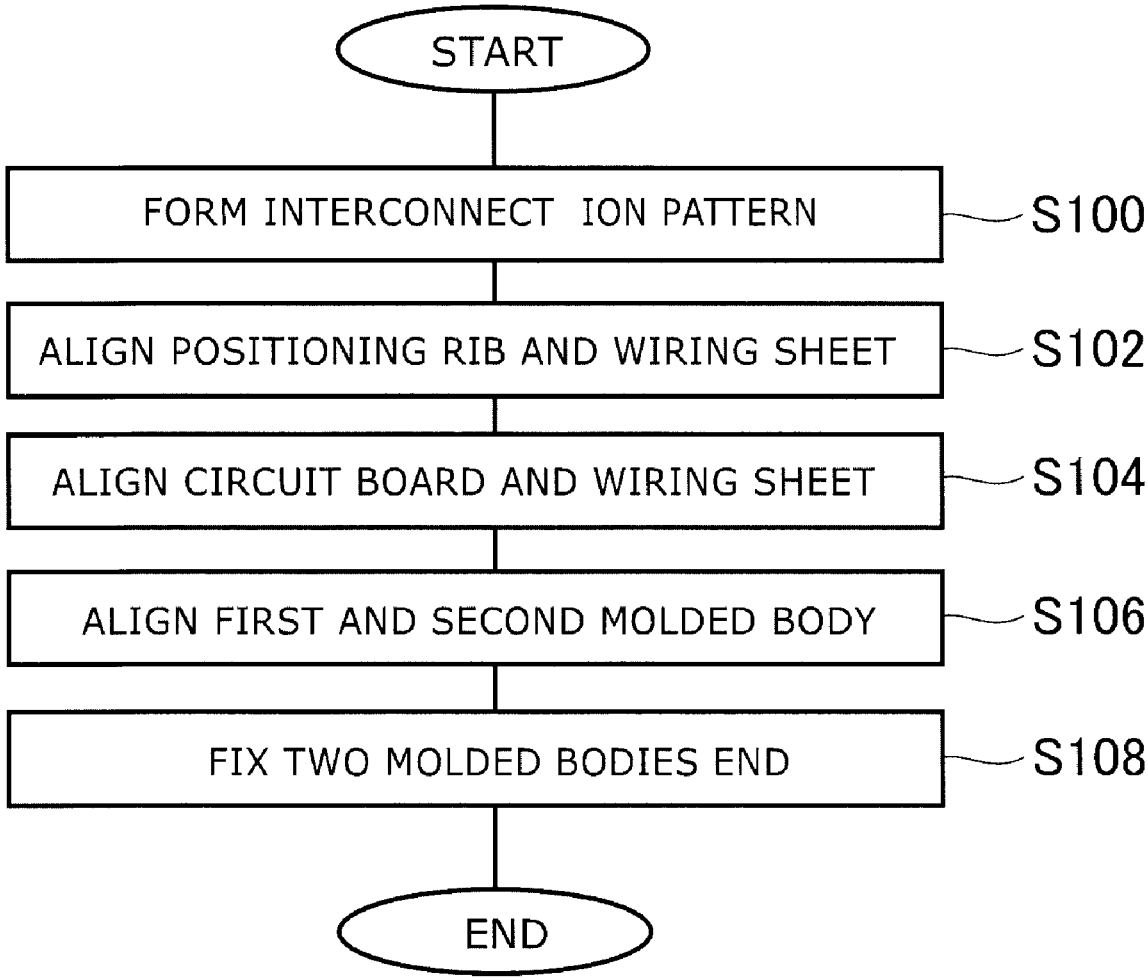
FIG. 3 is a flow chart showing a process for manufacturing the electronic device of FIG. 1.

Next, a method for manufacturing an electronic device of this embodiment is described with reference to a flow chart shown in FIG. 3. First, an interconnection pattern 44 is formed on the surface of an insulative sheet by printing, painting, or plating to serve as a wiring sheet (S100). Subsequently, as shown in FIG. 1C, the wiring sheet 40 provided with a notch 42 is aligned with a positioning rib 20*e* provided inside a second molded body 20 and is placed on the second molded body 20 (S102).

Subsequently, alignment is performed so that a feed point 32 provided on a circuit board 30 is connected to the other end of the interconnection pattern 44 provided on the wiring sheet 40, and the circuit board 30 is placed on the second molded body 20 via the wiring sheet 40 (S104).

Furthermore, the first and second molded body 10, 20 are aligned so as to sandwich the wiring sheet 40 and the circuit board 30 (S106), and fixed together (S108). Here, the first frame 10*a* includes a projected surface 10*b* and a surface 10*c* stepped therefrom. The second frame 20*a* includes a depressed surface 20*b* and a surface 20*c* stepped therefrom. The surface 10*b* is opposed to the surface 20*b*, and the surface 10*c* is opposed to the surface 20*c*, each serving as a mating surface. The feed line 14 extending on the surface 10*b* makes electrical contact with the interconnection pattern 44.

Figure 4A:
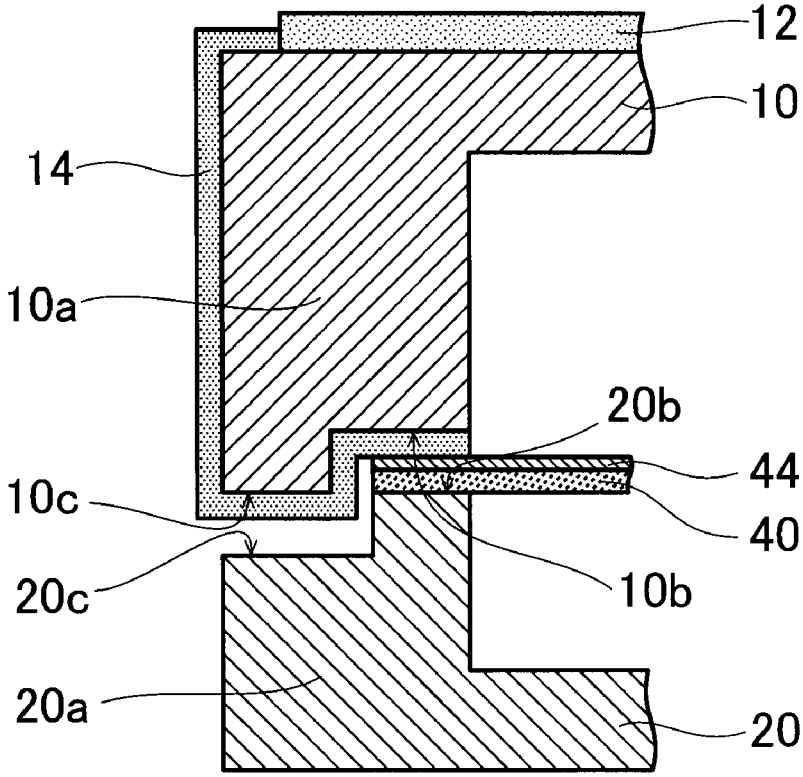
FIGS. 4A and 4B are schematic partial cross-sectional views of a variation of the mating surface.
Figure 4B:
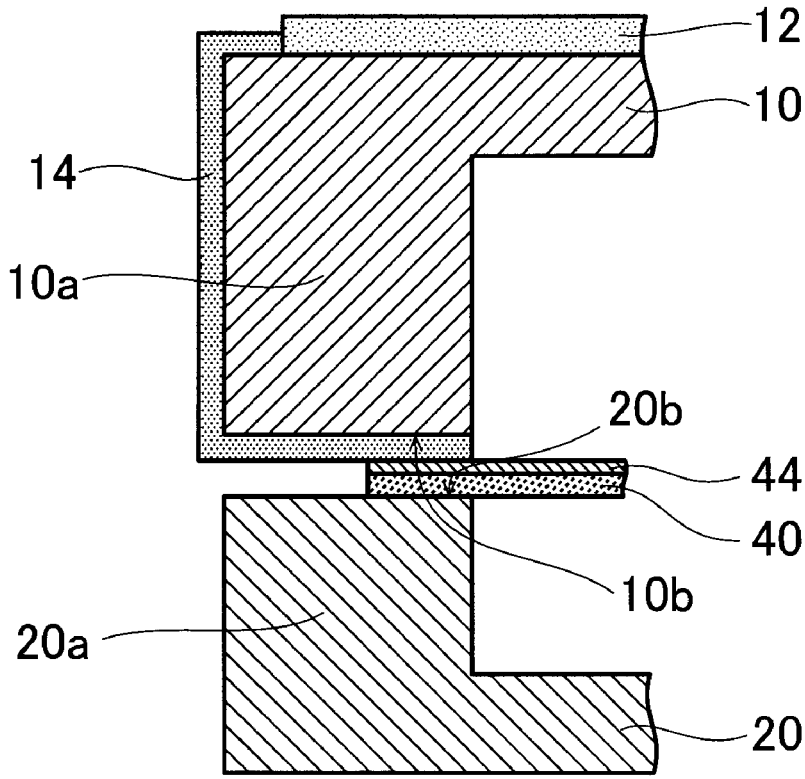

Next, a variation of the mating surface is described. FIG. 4 is a schematic partial cross-sectional view of the variation of the mating surface. FIG. 4A shows the case where the frame 10*a* of the first molded body 10 provided with a conductive pattern 12 and a feed line 14 has a depressed surface 10*b*. The frame 20*a* of the second molded body 20 also has a mating surface opposed thereto. FIG. 4B shows the case where the surface 10*b* and the surface 20*b* constituting the mating surfaces are flat. In this case, although the side surface of the wiring sheet 40 is exposed outside, the structure can be simplified.

The other end of the interconnection pattern 44 and the feed point 32 of the circuit board 30 are vertically sandwiched between the pressing ribs 10*d* and 20*d* to make electrical connection. Here, if the wiring sheet 40 is provided with an opening 41 as shown in FIG. 1C, multiple feed points 32 can be provided on the periphery of the circuit board 30. In the case where multiple feed points 32 are provided, positional precision can be favorably maintained by using a positioning rib 10*e* and a notch 42 as described above. It is noted that the circuit board 30 may be fixed by bonding, for example, without being sandwiched between pressing ribs 10*d* and 20*d*, and the feed point 32 may be electrically connected to the other end of the interconnection pattern 44.

According to this embodiment, a conductive pattern 12 such as an antenna provided on the outer surface 11 of the casing is connected to the circuit board 30 through the feed line 14 and the wiring sheet 40 provided on the surface of the molded body. Consequently, space for connection can be reduced as compared with connections based on a contact probe or a feed pin.

Here, a description is given of the antenna. FIG. 5 shows the configuration of the antenna. FIG. 5A shows a dipole antenna. The antenna pattern 12 has a length of approximately a half wavelength ($\lambda g/2$) and is excited at its middle portion by a feeder unit 50.

Figure 5B:
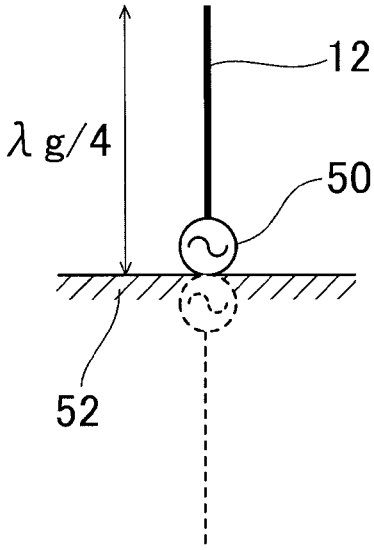
Figure 5C:
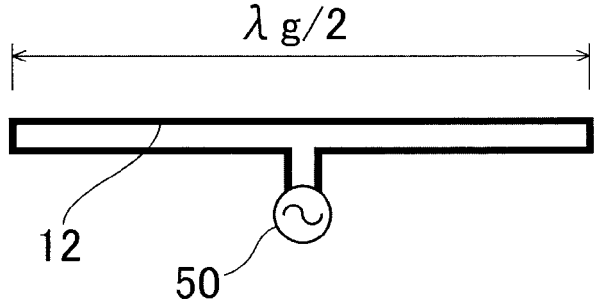

FIG. 5B shows a monopole antenna. The antenna pattern 12 has a length of approximately a quarter wavelength ($\lambda g/4$). It can be treated similarly to a half-wavelength antenna by considering a mirror image with respect to a ground plane 52 as represented by the dashed line.

FIG. 5C shows a folded dipole antenna, allowing high radiation efficiency based on high impedance.

Figure 5D:
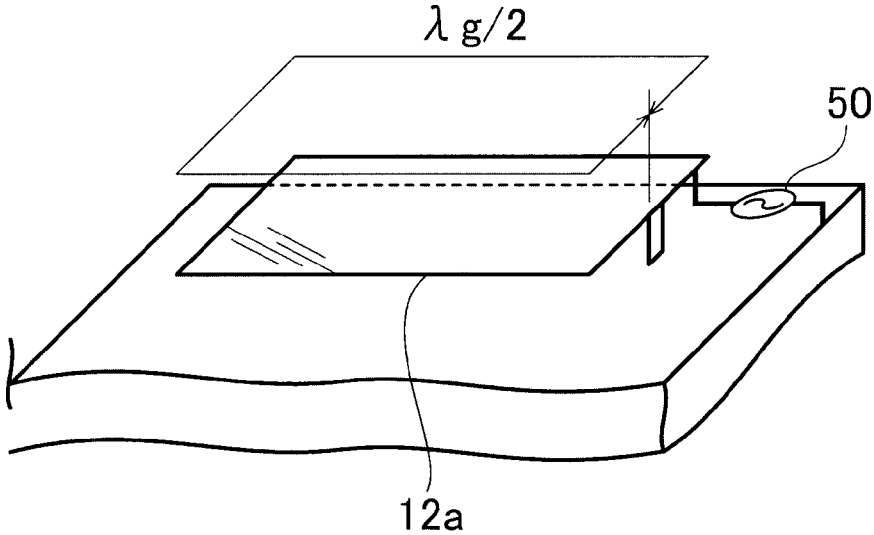

FIG. 5D shows an inverted-F antenna having a plate-like element 12*a*, which has a perimeter length of approximately a half wavelength. In this case, because the antenna excites the casing and passes a current therethrough, the effective size of the antenna can be increased.

In the case where a plurality of antennas selected from many antennas including those illustrated in FIG. 5 are placed on the outer surface 11 as shown in FIG. 1A, multi-band operation is facilitated by this embodiment, in which the connection space is easily reduced. More specifically, transmitting and receiving operations can be extended to the mobile phone triple band including GSM (Global System for Mobile communications), DCS (Digital Cellular System), and PCS (Personal Communications Service), as well as wireless LAN, FM and AM broadcasting, GPS (global positioning system), terrestrial digital broadcasting called One Seg, and electronic payment such as Felica™ and SUICA™.

Figure 6A:
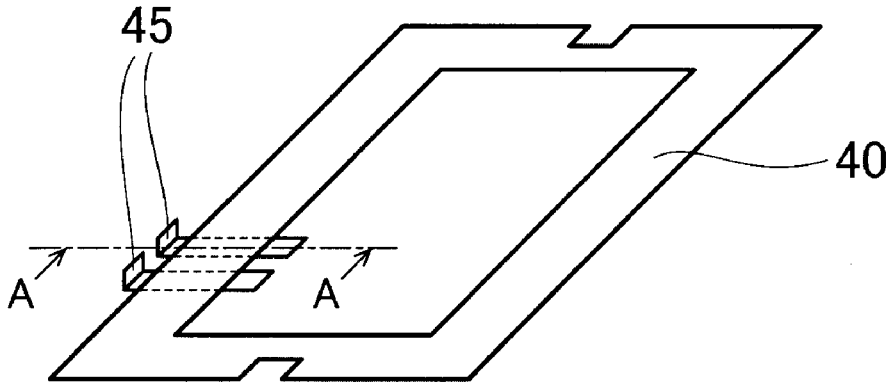
FIGS. 6A and 6B are schematic partial cross-sectional views showing a variation of this embodiment.
Figure 6B:
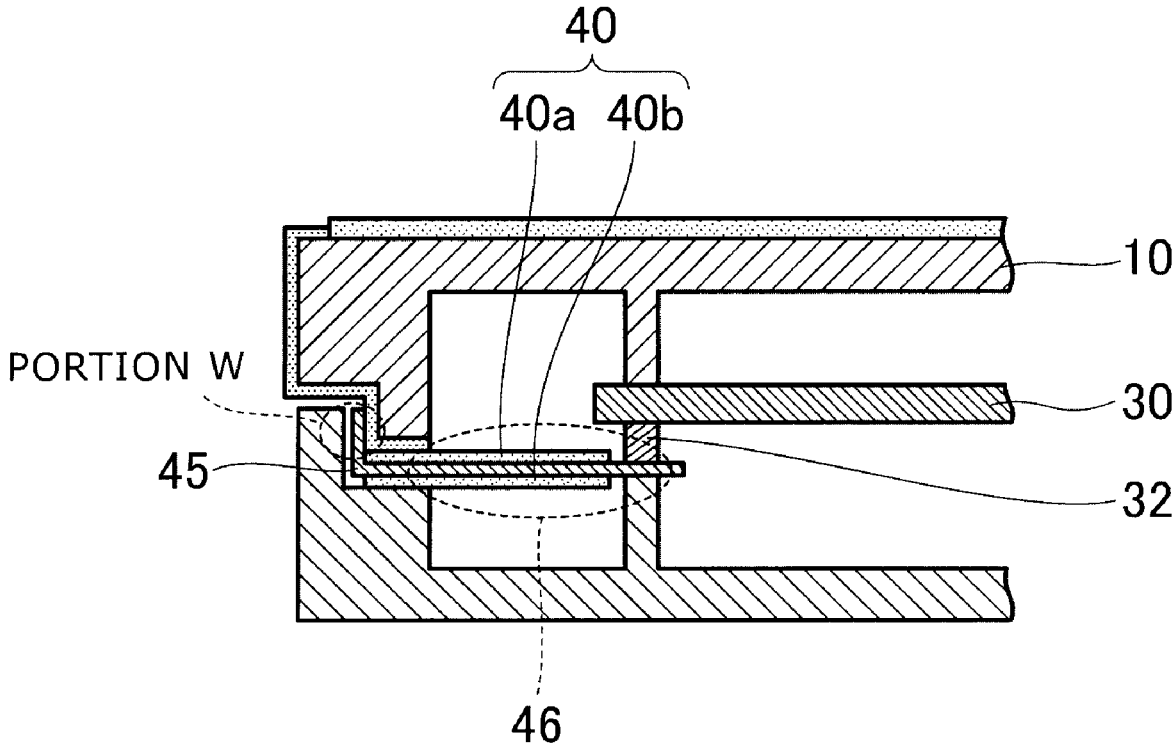

FIG. 6 is a schematic view showing a variation of this embodiment, where FIG. 6A is a schematic perspective view of a wiring sheet 40, and FIG. 6B is a partial schematic cross-sectional view of the electronic device taken along the dot-dashed line AA. The wiring sheet 40 of this variation has an interconnection pattern 45 that is made of a thin metal plate bent at 90 degrees. The interconnection pattern 45 is laminated between resin or other insulative sheets. The end bent at 90 degrees is sandwiched between the first and second frames 10*a*, 20*a* and connected to the feed line 14 at the portion W represented by the dashed line in FIG. 6B. This variation can also provide an electronic device having the same advantageous effect as the embodiment of FIG. 1.

The embodiments of the invention have been described with reference to the drawings. However, the invention is not limited to these embodiments. The shape, size, material, and arrangement of the molded body, circuit board, and wiring sheet constituting the electronic device, and the method for manufacturing the same, can be variously modified by those skilled in the art without departing from the spirit of the invention, and such modifications are also encompassed within the scope of the invention.

The invention claimed is:

1. An electronic device comprising:

a first molded body having a first frame, the first molded body being provided with a conductive pattern on an outer surface;

a second molded body having a second frame, the second molded body being joined to the first molded body;

a wiring sheet made of an insulative sheet provided with an interconnection pattern;

a circuit board having a feed point; and a feed line having a first end extended to a mating surface of the first frame opposed to the second frame and a second end connected to the conductive pattern, the interconnection pattern having a first end connected to the first end of the feed line, and the interconnection pattern having a second end connected to the feed point.

2. The electronic device according to claim 1, wherein the first molded body includes a first pressing rib inside, the second molded body includes a second pressing rib inside, the circuit board and the wiring sheet have second ends sandwiched between the first and second pressing rib, and the wiring sheet has a first end sandwiched between the first and second frame.

3. The electronic device according to claim 2, wherein the mating surface of the first frame has a step with an interior height being larger than an exterior height, and the second frame has a mating surface having a step with an interior height being smaller than an exterior height.

4. The electronic device according to claim 2, wherein the mating surface of the first frame has a step with an interior height being smaller than an exterior height, and the second frame has a mating surface having a step with an interior height being larger than an exterior height.

5. The electronic device according to claim 1, wherein the second molded body is provided with a positioning rib, and the wiring sheet is provided with a notch engaged with the positioning rib.

6. The electronic device according to claim 1, wherein the circuit board is bonded to one of the first molded body and the second molded body, and the wiring sheet has a first end sandwiched between the first and second frame.

7. The electronic device according to claim 6, wherein the second molded body is provided with a positioning rib, and the wiring sheet is provided with a notch engaged with the positioning rib.

8. The electronic device according to claim 6, wherein the mating surface of the first frame has a step with an interior height being larger than an exterior height, and the second frame has a mating surface having a step with an interior height being smaller than an exterior height.

9. The electronic device according to claim 6, wherein the mating surface of the first frame has a step with an interior height being smaller than an exterior height, and the second frame has a mating surface having a step with an interior height being larger than an exterior height.

10. The electronic device according to claim 1, wherein the wiring sheet has an opening.

11. The electronic device according to claim 1, wherein the interconnection pattern is a thin metal plate.

12. The electronic device according to claim 11, wherein the wiring sheet is made of the thin metal plate sandwiched on both sides between the insulative sheets.

13. The electronic device according to claim 1, wherein the conductive pattern includes an antenna pattern.

14. The electronic device according to claim 1, wherein the first and second molded body include resin.

15. A method for manufacturing an electronic device, the electronic device including:

a first molded body having a first frame, the first molded body being provided with a conductive pattern on an outer surface;

a second molded body having a second frame, the second molded body being joined to the first molded body;

a wiring sheet made of an insulative sheet provided with an interconnection pattern;

a circuit board having a feed point; and a feed line having a first end extended to a mating surface of the first frame opposed to the second frame and a second end connected to the conductive pattern, the interconnection pattern having a first end connected to the first end of the feed line, the interconnection pattern having a second end connected to the feed point, the circuit board being bonded to the first molded body or the second molded body, and the wiring sheet having a first end sandwiched between the first and second frame, the second molded body being provided with a positioning rib, and the wiring sheet being provided with a notch engaged with the positioning rib, the method comprising:

engaging the notch with the positioning rib;

bonding the circuit board to the first or second molded body; and fixing the wiring sheet so that the wiring sheet is sandwiched between the first and second molded body.

16. The method for manufacturing an electronic device according to claim 15, further comprising:

forming the conductive pattern by any one of printing, painting, and plating.

17. The method for manufacturing an electronic device according to claim 15, further comprising:

forming the interconnection pattern by any one of printing, painting, and plating.

18. A method for manufacturing an electronic device, the electronic device including:

a first molded body having a first frame, the first molded body being provided with a conductive pattern on an outer surface;

a second molded body having a second frame, the second molded body being joined to the first molded body;

a wiring sheet made of an insulative sheet provided with an interconnection pattern;

a circuit board having a feed point; and a feed line having a first end extended to a mating surface of the first frame opposed to the second frame and a second end connected to the conductive pattern, the interconnection pattern having a first end connected to the first end of the feed line, and the interconnection pattern having a second end connected to the feed point, the second molded body is provided with a positioning rib, and the wiring sheet is provided with a notch engaged with the positioning rib, the method comprising:

engaging the notch with the positioning rib; and fixing a second end of the wiring sheet and the circuit board so that a second end of the wiring sheet and the circuit board are sandwiched between the first and second pressing rib and that a first end of the wiring sheet is sandwiched between the first and second molded body.

19. The method for manufacturing an electronic device according to claim 18, further comprising:

forming the conductive pattern by any one of printing, painting, and plating.

20. The method for manufacturing an electronic device according to claim 18, further comprising:

forming the interconnection pattern by any one of printing, painting, and plating.

* * * * *